US006604518B1

(12) United States Patent
Sanford et al.

(10) Patent No.: US 6,604,518 B1
(45) Date of Patent: Aug. 12, 2003

(54) NON-LETHAL MUNITION SYSTEM FOR SHOULDER LAUNCHER

(75) Inventors: Matthew J. Sanford, Bel Alton, MD (US); Gregory D. DuChane, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/068,097

(22) Filed: Feb. 1, 2002

(51) Int. Cl.[7] ..... F41B 11/06
(52) U.S. Cl. ..... 124/56; 124/69; 434/16
(58) Field of Search ..... 124/74, 56, 69, 124/73, 60; 446/473; 42/105; 89/1.806; 434/16, 19, 24

(56) References Cited

U.S. PATENT DOCUMENTS

| | | | | | |
|---|---|---|---|---|---|
| 3,422,808 | A | | 1/1969 | Stein et al. | 124/11 |
| 3,428,037 | A | | 2/1969 | Capriolo et al. | 124/11 |
| 3,680,540 | A | * | 8/1972 | Stengl | 124/73 |
| 3,938,272 | A | * | 2/1976 | Ditto et al. | 42/55 |
| 4,094,294 | A | * | 6/1978 | Speer | 124/56 |
| 4,362,145 | A | * | 12/1982 | Stelcher | 124/32 |
| 4,369,592 | A | * | 1/1983 | Perry | 42/54 |
| 4,424,972 | A | * | 1/1984 | Vinette | 273/397 |
| 4,605,372 | A | * | 8/1986 | Nyzell | 434/16 |
| 5,230,324 | A | | 7/1993 | Van Horssen et al. | 126/61 |
| 5,343,849 | A | * | 9/1994 | Steer | 124/72 |
| 5,529,527 | A | * | 6/1996 | Watkins | 446/475 |
| 5,640,945 | A | | 6/1997 | Slonaker et al. | 124/56 |
| 5,832,911 | A | | 11/1998 | Mayville et al. | 124/73 |
| 5,877,448 | A | | 3/1999 | Denton et al. | 102/401 |
| 5,996,503 | A | | 12/1999 | Woodall et al. | 102/498 |
| 6,125,834 | A | * | 10/2000 | Ciccarelli et al. | 124/65 |
| 6,145,441 | A | | 11/2000 | Woodall et al. | 102/502 |

FOREIGN PATENT DOCUMENTS

| | | | | |
|---|---|---|---|---|
| JP | 09308700 | A | * 12/1997 | A62C/19/00 |

* cited by examiner

*Primary Examiner*—Charles T. Jordan
*Assistant Examiner*—John W. Zerr
(74) *Attorney, Agent, or Firm*—James B. Bechtel, Esq.; Matthew J. Bussan, Esq.; Peter J. Van Bergen, Esq.

(57) ABSTRACT

A self-contained non-lethal munition system is provided for use with a shoulder launcher. A barrel is coupled to a breech end of the launcher and is coaxially aligned therewith. A solid sphere having a hardness in the range of approximately 50 durometer is pressure sealed in the barrel. Launch pressure is supplied aft of the sphere. The launch pressure must overcome the sphere's pressure seal with the barrel and propel the sphere with a kinetic energy of between approximately 135–220 Joules/cm$^2$ for distances up to approximately 30 meters.

18 Claims, 1 Drawing Sheet

NON-LETHAL MUNITION SYSTEM FOR SHOULDER LAUNCHER

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to non-lethal weaponry, and more particularly to a non-lethal munition system for attachment to and use with a shoulder launcher.

BACKGROUND OF THE INVENTION

Conflicts between a small group of security personnel and a large group of antagonists or protestors frequently end up in relatively lengthy, tension-filled standoffs. Such conflicts can occur outside political buildings and embassies, at labor strike venues, at sites involving environmental issues, etc., where the protestors are generally unarmed civilians. In these situations, the use of conventional weapons (i.e., lethal weapons) is not practical, necessary or desirable as the firing of conventional lethal weapons at the small number of dangerous individuals puts many surrounding bystanders in danger of serious injury or death. Furthermore, since escalation of the conflict is generally advocated by only a few members of the protesting crowd, use of any non-lethal weapons should be specifically targeted.

Currently employed tactics for addressing these situations include dispersal of the crowd with high-pressure water sprays or non-lethal gas, or going into the crowd and trying to remove the few individuals attempting to escalate the conflict. However, dispersal of the crowd creates the threat of trampling those in the crowd or bystanders, while trying to remove certain individuals from the crowd places security personnel at risk.

SUMMARY OF THE INVENTION

Accordingly, it is an object of the present invention to provide a non-lethal munition.

Another object of the present invention is to provide a non-lethal munition that can accurately target a specific individual.

Still another object of the present invention is to provide a non-lethal munition that offers a simple and inexpensive solution to the problem of delivering an incapacitating impact to specifically targeted individuals.

Other objects and advantages of the present invention will become more obvious hereinafter in the specification and drawings.

In accordance with the present invention, a self-contained non-lethal munition system is provided for use with a shoulder launcher having a launch tube. The system includes a barrel coupled to a breech end of the launch tube and coaxially aligned therewith. A solid sphere of a compressible material (e.g., a standard lacrosse ball) having a hardness of approximately 50 durometer is positioned in the barrel and forms a pressure seal therewith. Pressurization means provide on-demand generation of a launch pressure aft of the solid sphere. The launch pressure must overcome the pressure seal that the solid sphere makes with the barrel and propel the solid sphere through the barrel and the launch tube with a kinetic energy of between approximately 135–220Joules/cm$^2$ for distances up to approximately 30 meters.

DETAILED DESCRIPTION OF THE INVENTION

Figure 1:
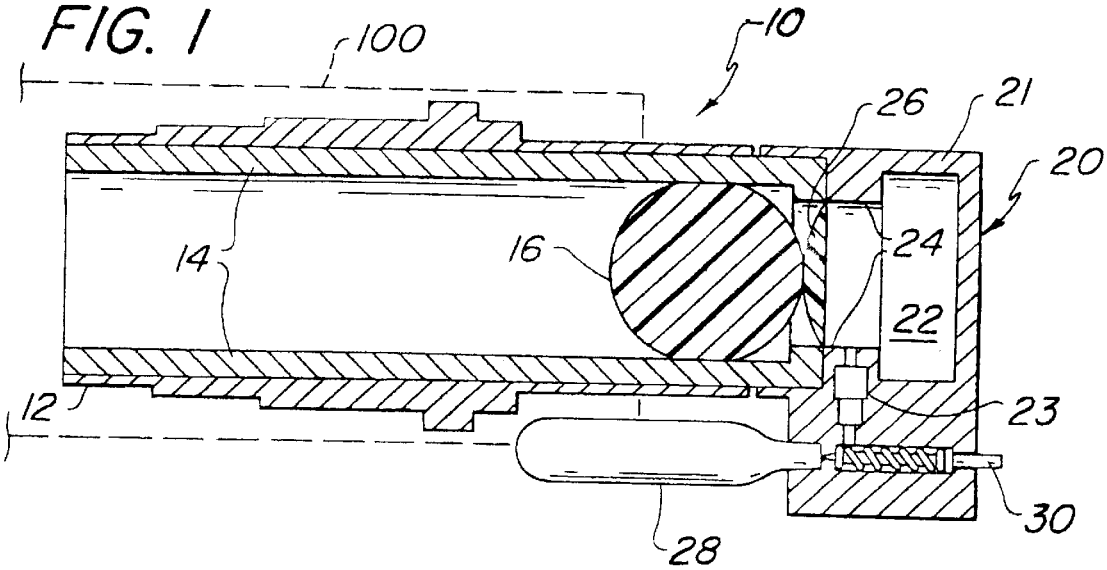
FIG. 1 is a cross-sectional view of an embodiment of a non-lethal munition system for use with a shoulder launcher in accordance with the present invention.

Referring now to the drawings, and more particularly to FIG. 1, a cross-sectional view of an embodiment of a nonlethal munition system according to the present invention is shown and referenced generally by numeral 10. Non-lethal munition system 10 is a self-contained munition for use with a conventional shoulder launcher. That is, munition 10 will be coupled to an existing launch tube thereby eliminating the need for an entire specialty weapon and the costs associated therewith. By way of illustrative example, munition system 10 will be described for use with the Marine Corps' shoulder launched multi-purpose assault rifle or SMAW as it is called.

As is known in the art, the aft end of the SMAW rifle's launch tube (referenced by dashed lines 100) is designed to receive various attachments. To exploit this feature, munition system 10 has a rigid outer casing 12 configured on its outer surface thereof for rigid mating with the aft end of the SMAW rifle's launch tube 100. Thus, it is to be understood that the particular configuration of casing 12 can be adapted for attachment to any launcher without departing from the scope of the present invention.

Disposed within and coupled to casing 12 is a constant diameter barrel 14. Casing 12 coaxially aligns barrel 14 with launch tube 100 which is of smaller caliber than launch tube 100. Note that casing 12 and barrel 14 could be integral with one another. However, by making them individual items, the present invention can be adapted for different sized non-lethal projectiles as will become more apparent from the following description.

Positioned in barrel 14 is a smooth sphere or ball 16 that provides stable flight characteristics over the relatively short range of interest in use of the present invention. To achieve a non-lethal yet incapacitating effect, ball 16 should be solid and made from a hard material. Further, to allow munition system 10 to operate simply and efficiently, ball 16 should have a diameter that is slightly larger than that of barrel 14 and should be slightly compressible. That is, when positioned in barrel 14, ball 16 should elastically compress slightly to form a pressure seal with barrel 14. The pressure seal need only be sufficient to keep ball 16 in place until it is to be fired from barrel 14.

Suitable physical attributes for ball 16 can be found in a standard lacrosse ball. Such balls are approximately 2.9 inches in diameter and weigh approximately 0.325 pounds. While materials used for lacrosse balls can vary somewhat, they are usually made from rubber or silicone and have a hardness of approximately 50 durometer (type A2) or "Shore Hardness" as it is referred to sometimes.

At the aft end thereof, munition system 10 includes its own launch mechanism 20 for launching ball 16 through barrel 14 and launch tube 100. Mechanism 20 must generate a launch pressure that i) overcomes the pressure seal formed between barrel 14 and ball 16, and ii) propels ball 16 with the proper amount of kinetic energy to deliver a non-lethal yet incapacitating impact. In the illustrated embodiment, launch mechanism 20 includes a housing 21 coupled to the aft end of barrel 14. Housing 21 defines a chamber 22 therein having an opening 24 communicating with barrel 14 just behind ball 16. Opening 24 is sealed by a rupturable disk or diaphragm 26. A container 28 of gas (e.g., carbon dioxide, . . . ) under high pressure is selectively opened by means of, for example, a firing pin 30 that is spring-biased to extend outward from mechanism 20 and out of engagement with container 28.

In operation, with munition system 10 coupled to launch tube 100, a user presses firing pin 30 to open container 28 and allow high pressure gas from container 28 to enter chamber 22 via a port 23. Pressure increases in chamber 22 until diaphragm 26 fails. Diaphragm 26 is designed to fail at a specified launch pressure that will propel ball 16 through barrel 14 and launch tube 100 to generate the desired level of kinetic energy.

For munitions system 10 to deliver a non-lethal yet incapacitating blow to a target, a balance must be struck between i) projectile size, shape, weight and hardness, ii) speed of the projectile, and iii) distance that the projectile must travel. In crowd control situations, when the distance between security personnel and a hostile crowd becomes small (i.e., generally approximately 30 meters or less), the possibility of conflict escalation increases. Over the 30 meter distance, a projectile must have a stable flight path in order to deliver its non-lethal incapacitating impact force to the appropriate target. The smooth and solid attributes of ball 16 provide for a stable flight path while its elastic compressibility allow it to deform slightly for passage through barrel 14.

To incapacitate its target in a non-lethal manner, ball 16 should have a kinetic energy in the range of approximately 135–220 Joules/centimeter$^2$ (cm$^2$). It has been found that for solid lacrosse balls weighing approximately 0.325 pounds, the necessary kinetic energy can be achieved throughout the 30 meter range of interest by achieving ball velocities in the range of approximately 95–125 miles per hour.

Figure 2:
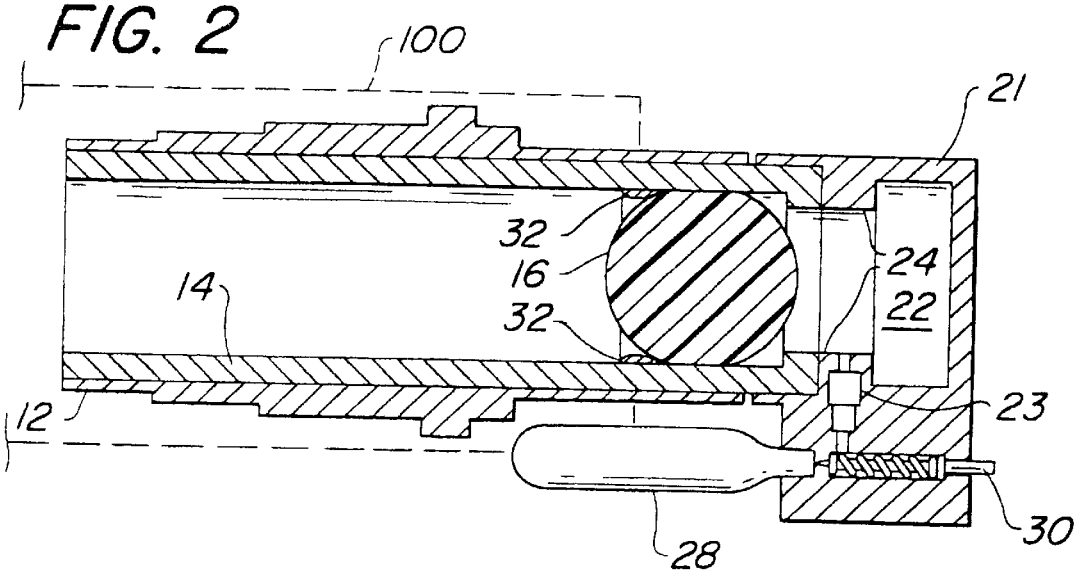
FIG. 2 is a cross-sectional view of another embodiment of a non-lethal munition system for use with a shoulder launcher in accordance with the present invention.

Another embodiment of the present invention is illustrated in FIG. 2 where like reference numerals are used for the elements that are common with elements in the FIG. 1 embodiment. Such common elements will not be described further herein. In FIG. 2, an annular ridge 32 replaces rupturable diaphragm 26 (FIG. 1). Thus, chamber 22 essentially includes the portion of barrel 14 aft of ball 16. Annular ridge 32 is sized and shaped to axially restrain ball 16 in barrel 14 both prior to use and as pressure increases in chamber 22. However, once pressure in chamber 22 has reached a predetermined launch pressure, ball 16 deforms (i.e., elastically compresses) and is pushed through annular ridge 32, barrel 14 and launch tube 100.

Figure 3:
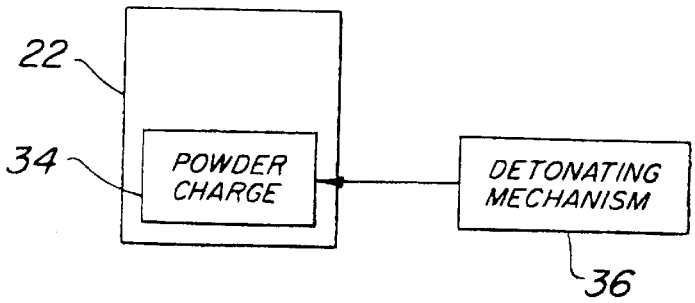
FIG. 3 is a block diagram of another type of launching mechanism that can be used in the present invention.

Although the previous two embodiments have made use of pressurized gas as the source for generating launch pressure for ball 16, the present invention is not so limited. For example, FIG. 3 depicts in block diagram form another mechanism that can be used to selectively generate launch pressure for either of the FIG. 1 or FIG. 2 embodiments of the present invention. Specifically, a powder charge 34 could be maintained in chamber 22. A firing mechanism 36 would provide on-demand initiation of powder charge 34. The resulting burning gases generated by the burning powder charge provide the necessary launch pressure increase in chamber 22.

The advantages of the present invention are numerous. A self-contained non-lethal munition system can be used with an existing shoulder launcher. Conversion from a lethal weapon to a non-lethal weapon is quick and simple. The use of a conventional lacrosse ball as the non-lethal projectile provides a readily available and inexpensive ammunition source. The present invention can deliver its non-lethal incapacitating blow accurately over a critical range thereby eliminating the need for security people to enter a hostile crowd while allowing only specific targets to be affected.

Although the invention has been described relative to a specific embodiment thereof, there are numerous variations and modifications that will be readily apparent to those skilled in the art in light of the above teachings. For example, the present invention could be adapted so that each munition system has multiple balls available for firing sequentially at different targets. In addition, other size/weight balls could be used depending on the kinetic energy required at impact. It is therefore to be understood that, within the scope of the appended claims, the invention may be practiced other than as specifically described.

What is claimed as new and desired to be secured by Letters Patent of the United States is:

1. A non-lethal weapon, comprising:

a conventional projectile-launching weapon having a launch tube that is opened at an aft end thereof;

a self-contained munition assembly fitted in and coupled to said aft end of said launch tube, said self-contained munition assembly including (i) a barrel coupled to said aft end of said launch tube and coaxially aligned therewith;

(ii) a solid sphere of a compressible material having a hardness of approximately 50 durometer, said solid sphere positioned in said barrel and forming a pressure seal therewith; and (iii) means coupled to said barrel for on-demand generation of a launch pressure aft of said solid sphere, said launch pressure overcoming said pressure seal to propel said solid sphere through said barrel and said launch tube with a kinetic energy of between approximately 135–220 Joules/cm$^2$ for distances up to approximately 30 meters.

2. A non-lethal weapon as in claim 1 wherein said solid sphere is a lacrosse ball.

3. A non-lethal weapon as in claim 1 wherein said means for on-demand generation of said launch pressure comprises:

a chamber defined aft of said solid sphere, said chamber having an opening in communication with said barrel aft of said solid sphere;

first means coupled to said chamber for increasing pressure in said chamber when activated;

second means for activating said first means wherein said pressure in said chamber increases; and third means for maintaining a fixed volume in said chamber until said pressure in said chamber reaches said launch pressure, wherein said third means fails to maintain said fixed volume and said launch pressure propels said solid sphere through said barrel and said launch tube.

4. A non-lethal weapon as in claim 3 wherein said first means comprises a container of pressurized gas.

5. A non-lethal weapon as in claim 4 wherein said gas is carbon dioxide.

6. A non-lethal weapon as in claim 3,wherein said first means comprises a powder charge.

7. A non-lethal weapon as in claim 3 wherein said third means comprises a rupturable diaphragm that seals said opening and ruptures when said pressure in said chamber increases to said launch pressure.

8. A non-lethal weapon as in claim 3 wherein said third means comprises an annular ridge coupled to and extending radially inward from said barrel forward of said solid sphere, said annular ridge restraining forward axial movement of said solid sphere until said pressure in said chamber increases to said launch pressure wherein said solid sphere elastically deforms to pass through said annular ridge.

9. A non-lethal weapon comprising:

a conventional projectile-launching weapon having a launch tube that is opened at an aft end thereof;

a self-contained munition assembly fitted in and coupled to said aft end of said launch tube, said self-contained munition assembly including (i) a constant caliber barrel;

(ii) an outer casing disposed about and coupled to said barrel, said outer casing including means for rigid coupling to an interior portion of said aft end of said launch tube, wherein said outer casing coaxially aligns said barrel within said launch tube;

(iii) a solid sphere of a compressible material having a hardness of approximately 50 durometer, said solid sphere positioned in said barrel and forming a pressure seal therewith; and (iv) means coupled to said barrel for overcoming said pressure seal to propel said solid sphere through said barrel and said launch tube with a kinetic energy of between approximately 135–220 Joules/$cm^2$ for distances up to approximately 30 meters.

10. A non-lethal weapon as in claim 9 wherein said solid sphere is a lacrosse ball.

11. A non-lethal weapon as in claim 9 wherein said means comprises:

a chamber defined aft of said solid sphere, said chamber having an opening in communication with said barrel aft of said solid sphere;

a rupturable diaphragm sealing said opening; and pressure means coupled to said chamber for selectively increasing pressure in said chamber until said rupturable diaphragm fails and said solid sphere is propelled through said barrel and said launch tube.

12. A non-lethal weapon as in claim 11 wherein said pressure means includes a container of pressurized gas.

13. A non-lethal weapon as in claim 12 wherein said gas is carbon dioxide.

14. A non-lethal weapon as in claim 11 wherein said pressure means includes a powder charge.

15. A non-lethal weapon as in claim 9 wherein said means comprises:

a chamber defined aft of said solid sphere, said chamber having an opening in communication with said barrel aft of said solid sphere;

an annular ridge coupled to and extending radially inward from said barrel forward of said solid sphere, said annular ridge restraining forward axial movement of said solid sphere; and pressure means coupled to said chamber for increasing pressure in said chamber until said solid sphere elastically deforms, passes through said annular ridge and is propelled through said barrel and said launch tube.

16. A non-lethal weapon as in claim 15 wherein said pressure means includes a container of pressurized gas.

17. A non-lethal weapon as in claim 16 wherein said gas is carbon dioxide.

18. A non-lethal weapon as in claim 15 wherein said pressure means includes a powder charge.

* * * * *